United States Patent [19]

Havelka et al.

[11] Patent Number: 4,643,372

[45] Date of Patent: Feb. 17, 1987

[54] GROOVED ROTARY YARN DISTRIBUTOR FOR WINDING CONICAL BOBBINS

[75] Inventors: Jiljí Havelka; Petr Jirásko; Zdenek Koloc; Miroslav Václavík, all of Liberec, Czechoslovakia

[73] Assignee: Elitex, koncern textilniho strojirenstvi, Liberec, Czechoslovakia

[21] Appl. No.: 840,595

[22] Filed: Mar. 17, 1986

[30] Foreign Application Priority Data

Mar. 18, 1985 [CS] Czechoslovakia ..... 1892-85

[51] Int. Cl.[4] ..... B65H 54/48

[52] U.S. Cl. ..... 242/43.2

[58] Field of Search ..... 242/43.2, 43 R, 18.1, 242/158.5

[56] References Cited

U.S. PATENT DOCUMENTS

| | | | |
|---|---|---|---|
| 1,749,355 | 3/1930 | Reece | 242/43.2 |
| 1,836,105 | 12/1931 | Bood | 242/43.2 |
| 1,918,210 | 7/1933 | McKean | 242/43.2 |
| 2,969,198 | 1/1961 | Wolff | 242/43.2 |
| 2,998,203 | 8/1961 | Pitts | 242/43.2 |
| 3,801,034 | 4/1974 | Tsukuma et al. | 242/43.2 |
| 3,945,581 | 3/1976 | Schippers et al. | 242/43.2 X |

FOREIGN PATENT DOCUMENTS

| | | | |
|---|---|---|---|
| 12739 | 9/1962 | Japan | 242/43.2 |
| 683508 | 11/1950 | United Kingdom | 242/43.2 |

*Primary Examiner*—Stanley N. Gilreath

[57] ABSTRACT

Grooved rotary yarn distributor for the winding of bobbins of conical or varioconical shape, the distributor having a reversible, crossing helical groove, and a variable radius of the groove bottom, the conical and varioconical bobbins having a variable crossing angle of the wound yarn. The bottom of the distributing groove of the yarn distributor has a first derivative of the axial coordinate of the groove bottom is, according to the angular coordinate, an increasing function of the angular coordinate in the proximity of a selected point in the case, when the first derivative of the radius of the groove bottom according to the angular coordinate is a decreasing function of the angular coordinate in the proximity of the selected point, and is decreasing in the case, when the first derivative of the radius of the groove bottom, according to the angular coordinate is an increasing function of the angular coordinate in proximity of the selected point upon growth of the axial coordinate of the groove bottom only in the direction of distribution from the small end towards the large end of the conical or varioconical bobbin from zero to the maximum value of stroke of the grooved rotary yarn distributor.

2 Claims, 6 Drawing Figures

GROOVED ROTARY YARN DISTRIBUTOR FOR WINDING CONICAL BOBBINS

This application is related to the coassigned application Ser. No. 840,516, filed Mar. 17, 1986. The present application relates to a groove rotary yarn distributor of cylindrical shape, such distributor having a reversible, crossing helical groove, and a various radius of its bottom, said yarn distributor being intended for wounding yarn onto a conical bobbin with a variable crossing angle of the helix of wound yarn, such bobbin being adapted for use in textile machines.

In groove rotary yarn distributors of the above type, which have been previously known, the rise of the groove or of its bottom passes continuously from a minimum to a maximum value. These rotary distributors, which have a variable radius of the groove bottom, and in which the distance of the point of contact of the yarn at the groove bottom and the point of contact of the yarn on the bottom, are variable and do not wind the yarn onto the bobbin with the necessary crossing angle.

Groove rotary yarn distributors for winding cross wound bobbins with a continuously varying rise of the groove in both branches thereof are known. In such distributors, the groove parts which guide the yarn from the ends of the bobbins toward its center have a higher rise than the groove parts guiding the yarn from the center of the bobbin toward its ends. In such distributors, the sum of the length of two sections on both branches of the groove of the grooved rotary yarn distributor is in the same axial sections thereof, in the middle of the lift yarn path, and are of at least the same value as the sum of the length of two sections of the groove of said grooved rotary yarn distributor at the ends of the lift yarn path. The course of the sum of the length of two sections in both branches of the groove are continuous in those parts of the grooved rotary yarn distributor which follow each other.

The disadvantage of the above-described known types of grooved rotary yarn distributors consists in that they do not meet the requirement of the depositing yarn on a bobbin with flange-shaped outline of the bobbin jacket with a constant density.

The present invention has among its objects the mitigation of the above-described disadvantage of the prior art distributors to a maximum possible extent by approaching the ideal shape of the winding upon maintaining it with a constant density along the whole extent of the winding. It is also the purpose of the present invention to make it possible to machine the grooved rotary yarn distributor in numerically controlled milling machines with a continuous path control.

The above objects are achieved to a considerable extent by the grooved rotary yarn distributor, according to the present invention. In such distributor, the first derivative of the axial coordinate of the bottom of the distributor groove, according to the angular coordinate, is in the neighbourhood of a selected point and is an increasing function of the angular coordinate in the case in which the first derivative of the radius of the groove bottom, according to the angular coordinate, is a decreasing function of the angular coordinate in the neighborhood of the selected point, and decreases in the case in which the first derivative of the radius of the groove bottom, according to the angular coordinate, is an increasing function of the angular coordinate in the neighborhood of the selected point upon growth of the axial coordinate only in the direction of distribution of the yarn from the small end to the large end of the conical bobbin from zero up to the maximum value of upstroke of the grooved rotary yarn distributor.

The axial coordinate in this selected point is relative to the axial coordinate of an imaginary helix axially displaced within the range of $\pm 20$ millimeters; according to the conicity of the bobbin, there is the crossing of yarn on the bobbin, as well as the diameter and the shape of the distributor.

The advantage of the grooved rotary yarn distributor, according to the present invention, consists in that the inconvenient affect of a variable radius of the groove bottom, particularly at the crossing point of the groove, is eliminated; this is advantageous, particularly for the structure of the winding, as well as for the fact that the wound bobbin has substantially more even density and hardness.

Further advantages and features of the present invention will be more readily apparent from a consideration of the illustrated embodiment thereof as shown in the accompanying drawings, in which.

Figure 1:
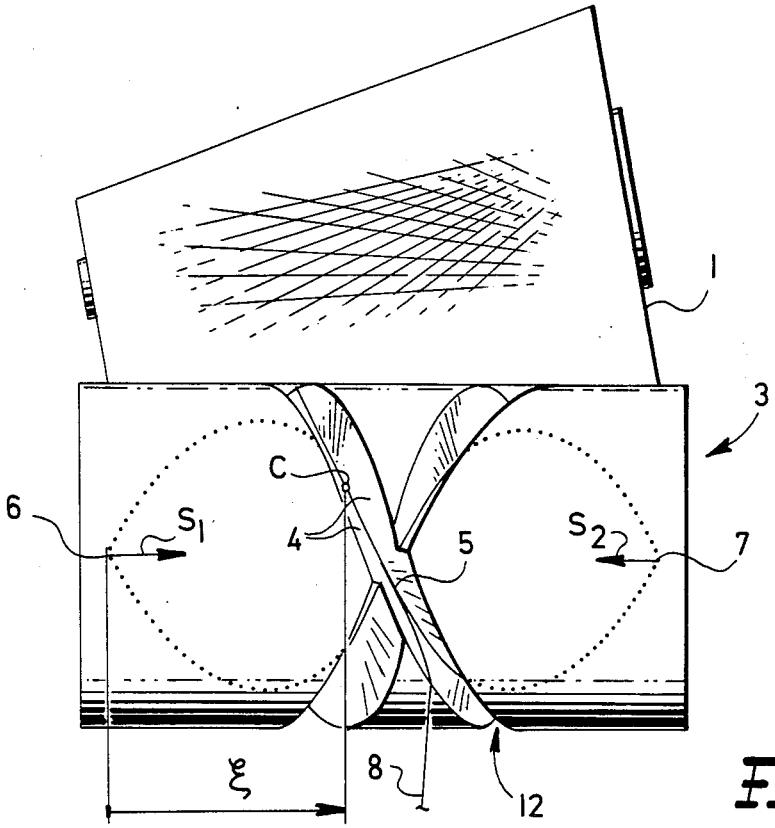
FIG. 1 is a view in elevation of the grooved rotary yarn distributor in combination with a conical bobbin which is being wound.

The groove rotary yarn distributor 3 for yarn 8 is provided with a reversible crossing groove 12 with two walls 4, a bottom 5, and a variable radius $\rho$. Against the grooved rotary yarn distributor 3 for yarn 8, there bears a conical bobbin 1 which is driven by the yarn distributor. The angle between the walls 4 of groove 12 is such that yarn 8 leaves the bottom 5 of the groove 12 toward the bobbin 1 along a straight line and is not bent over the wall 4.

Figure 2:
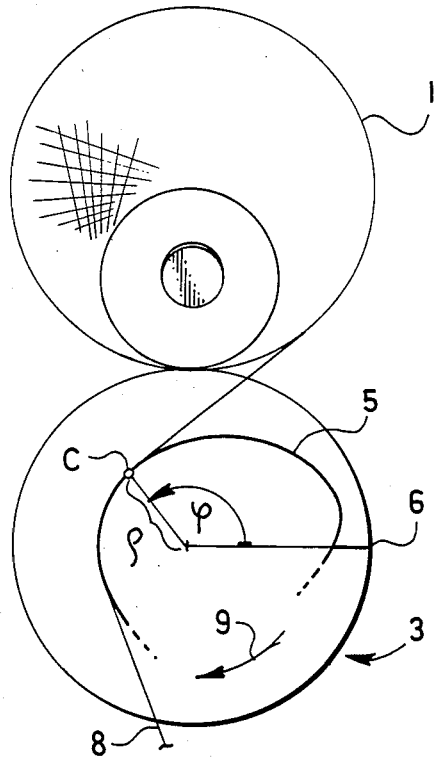
FIG. 2 is a side view of the combination shown in FIG. 1, the view being taken in direction from right to left in FIG. 1.
Figure 3:
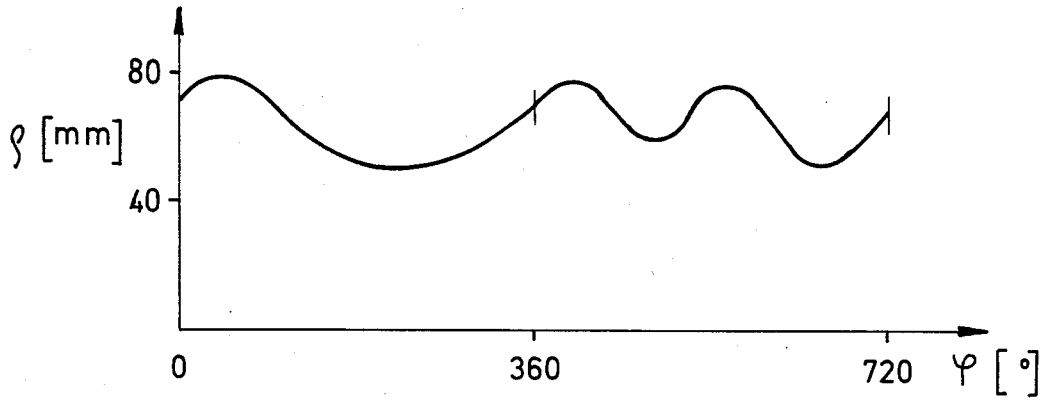
FIG. 3 is a graph of the function of the radius of the groove bottom of the grooved rotary yarn distributor in dependence upon the angle $\psi$ (psi)

It follows from this that yarn 8 is distributed by the bottom 5 of groove 12, leaving it, e.g. at point C (FIGS. 1 and 2). As shown in FIG. 2, the yarn distributor rotates clockwise as shown by the arrow 9; consequently, the bobbin 1 rotates in a counterclockwise direction.

Thus, the yarn 8 is always distributed relative to the turning of the grooved rotary yarn distributor 3 by the appurtenant point C of the bottom 5 of the groove 12; the point C is acutally an imaginary guiding eyelet for yarn 8, moving between the dead points 6, 7 of the groove 12. For the definition of the bottom 5 of groove 12 of the grooved rotary yarn distributor 3 for yarn 8, three cylindrical coordinates are used.

These coordinates are:

(1) The axial coordinate $\xi$ in the direction of the axis of rotation of the grooved rotary yarn distributor 3 with the starting point in the dead point 6 of the grooved rotary yarn distributor 3, (2) The angular coordinate $\psi$ measured in a plane perpendicular to the axis of the groove yarn, grooved rotary yarn distributor 3 from the dead point 6 on the small flange of bobbin 1 in the direction of rotation 9 of the grooved rotary yarn distributor 3 upon winding yarn 8 onto bobbin 1 from zero to the maximum angular value, which corresponds to a double stroke of the grooved rotary yarn distributor 3, this representing an angle of 720 degrees.

(3) The third coordinate, which defines the bottom 5 of groove 12, is radial coordinate $\rho$, this being radius of the bottom 5 of the groove 12.

The movement of the imaginary distributing eyelet for yarn 8, i.e. point C, is defined in such manner that the yarn 8, arriving at the bobbin 1, fulfills the given conditions of a theoretical winding, i.e. constant density and hardness. This means that the separate positions of point C are determined on the basis of the shape of the theoretical winding and the mutual properties of the functions $\rho=\rho(\psi)$ and $\xi=\xi(\psi)$ in the proximity of the selected position of point C of the bottom 5 of groove 12 of the grooved rotary yarn distributor 3.

The theoretical winding on the conical bobbin 1 with a variable crossing angle of the wound yarn 8, which fulfills the condition of constant density and hardness, is the circle involute on a developed area of the conical bobbin 1, said circle involute being very close to a conical helix with constant lead. For a varioconical bobbin 1 with a variable crossing angle of the wound yarn 8 for a various basic conicity of the tube and the required increase of conicity of the bobbin 1, its curve, which has at the smaller end of the bobbin 1 a larger angle, and at the larger end of the bobbin 1 a smaller angle of yarn crossing, than the conical winding of a conical bobbin, formed by the distributor 3 of the same type as the distributor 3 for a varioconical winding of yarn 8, the grooved rotary yarn distributor 3 have the same diameter and the same maximum angular value of the separate strokes of groove 12 in the distributing directions $S_1$ and $S_2$, the crossing angle of yarn 8 on the bobbin 1 does constantly diminishes the direction from the small flange to the large flange of the bobbin 1. The term "crossing angle" represents the double value of the acute angle between the tangent to yarn 8 and the line normal to the axis of bobbin 1.

The condition for the course of radius $\rho$ of the bottom 5 of groove 12 consists in that at the point of crossing of groove 12 there must be at least such a difference of radii $\rho$ of the crossing sections of groove 12 that the safe guarding of yarn in both directions $S_1$ and $S_2$ is guaranteed. In the remaining parts of the bottom 5 of groove 12, it is suitable to maintain the condition of continuous transition of radius $\rho$ from one value to the other. It follows from this that the condition of accurate and perfect distribution of yarn 8 in the direction $S_1$ and $S_2$ is a primary factor, and at the same time determines the course of the function $\rho=\rho(\psi)$. The rectilinear section of yarn 8 between the grooved rotary distributor 3 and the bobbin 1 (FIG. 2) is not of zero value and varies in dependence upon the course of the function $\rho=\rho(\psi)$ of the radius of bottom 5 of groove 12. Therefore, the value of the axial coordinate $\xi$ of the selected point C of bottom 5 of groove 12 is in relation to the course of the function, $\rho=\rho(\psi)$ in the proximity of selected point C, such that yarn 8 leaves bottom 5 of groove 12 along a tangent to the theoretical winding of yarn 8 upon bobbin 1.

For the purpose of determining the course of axial coordinates $\xi$ in dependence upon the angle $\psi$ i.e. the course of the function $\xi=\xi(\psi)$ is in the exemplary embodiment for a conical or varioconical bobbin 1, in accordance with FIG. 1, is considered a grooved rotary yarn distributor 3 for yarn 8 of cylindrical shape, having a diameter of 160 millimeters, a stroke of 150 millimeters, one crossing of groove 12, i.e. on double stroke being preformed by turning the grooved rotary yarn distributor 3 through an angle of 720 degrees for winding yarn 8 on a conical bobbin 1 with a conicity of 6 degrees, or for winding yarn 8 on a varioconical bobbin 1 with a basic conicity of the tube of 4 degrees, 20 minutes, and a very small growth of conicity of the varioconical bobbin 1.

Figure 4:
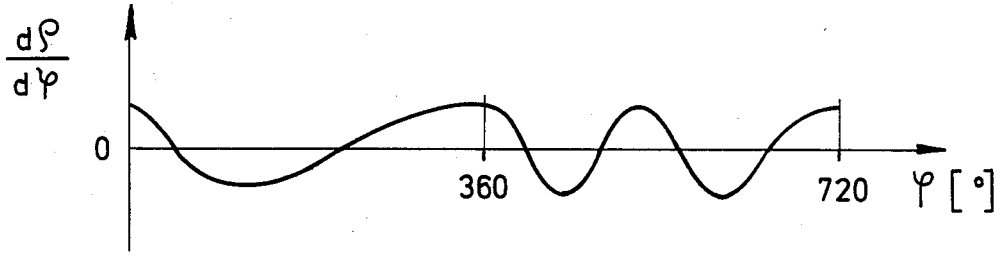
FIG. 4 is a graph of the function of the first derivative of the radius $\rho$ (rho) of the groove bottom of the grooved rotary yarn distributor, according to the angle $\psi$ in dependence upon the angle $\psi$.

The course of radius $\rho$ of the bottom 5 of groove 12 in dependence upon the angle $\psi$ within the section of double stroke, in relation to the above-mentioned condition, is depicted in FIG. 1 where on the vertical axis there is plotted radius $\rho$ of the bottom 5 of groove 12, and on the horizontal axis there is plotted the angle $\psi$. For this selected radius flow of bottom 5 of groove 12, the character of the first derivative of radius $\rho$ of the bottom 5 of groove 12, according to the angular coordinates $\rho$ as a function of coordinate $\xi$ is represented in FIG. 4. On the vertical axis, there are plotted the values of the first derivative ($d\rho/d\psi$), and on the horizontal axis there is plotted the coordinate $\psi$ in the double stroke section.

Figure 6:
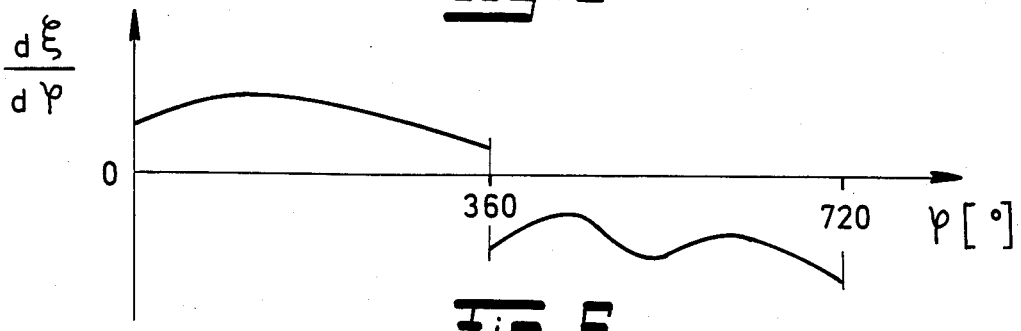
FIG. 6 is a graph of the function of the first derivative of axial coordinate $\xi$ of the groove bottom points of the groove bottom of the grooved rotary yarn distributor, according to the angle $\psi$ in dependence upon the angle $\psi$.

In FIG. 6, the character of the first derivative of the axial coordinate $\xi$ is drawn in accordance with the angular coordinates $\xi$ as a function of the coordinate $\xi$ of the grooved rotary yarn distributor 3 for wounding yarn on a conical or varioconical bobbin 1. The character of this function and thus also the shape of the bottom 5 of groove 12 of the grooved rotary yarn distributor 3 for winding yarn 8 on a conical or varioconical bobbin 1 is determined from the condition of the theoretical winding of a conical or varioconical bobbin 1 with an even density and hardness in such manner that the first derivative of the axial coordinate $\xi$ in accordance with the angular coordinates $\psi$ is an increasing function of the angular coordinate $\psi$ in the proximity of the selected point C in the case in which the first derivative of the radius $\rho$ of bottom 5 of groove 12 is, according to the angular coordinate, $\psi$ in proximity of the selected point C, decreasing in the case in which the first derivative of radius $\rho$ of bottom 5 of groove 12, according to the angular coordinate $\psi$ is an increasing function of the angular coordinate $\psi$ in proximity to the selected point C upon growth of the axial coordinate $\xi$ only in the direction of distribution $S_1$ from the small end towards the large end of the conical or varioconical bobbin 1 from zero up to the maximum value of stroke of the grooved rotary yarn distributor 3 for yarn 8. On the vertical axis of the graph of FIG. 6, the values of the first derivatives ($d\xi/d\psi$)are plotted, and in the horizontal axis of such figures, a coordinate $\xi$ is plotted in the section of double stroke.

Figure 5:
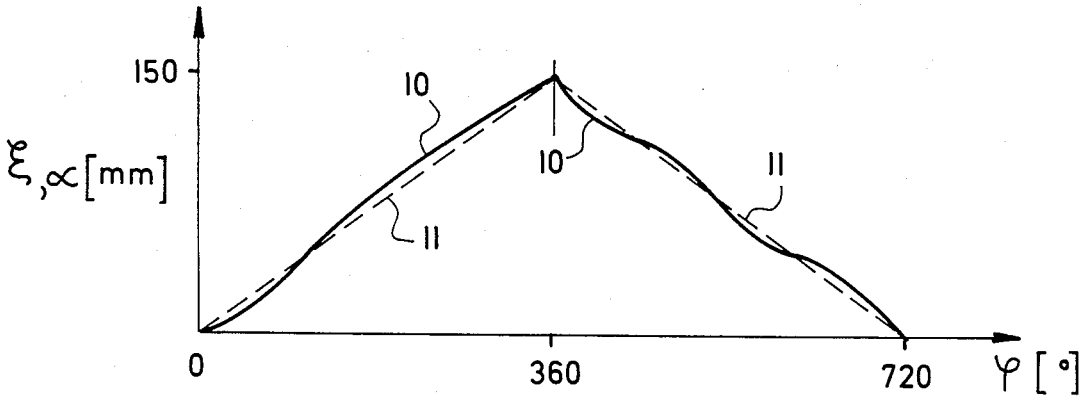
FIG. 5 is a graph of the function of the axial coordinate $\xi$ (xi) of the groove bottom points of the grooved rotary yarn distributor and the axial coordinate $\alpha$ (alpha) of the imaginary helix with constant lead in dependence upon the angle $\rho$.

According to the course of the function in FIG. 6, the character of the function $\xi=\xi(\psi)$ in FIG. 5 is given, i.e. that the axial coordinates of the separate positions of point C, and these axial coordinates $\xi$ of the actual helix with a variable rise of the bottom 5 of groove 12 of the grooved rotary yarn distributor 3 for winding yarn 8 onto a conical or varioconical bobbin 1 are relative to the axial coordinates $\alpha$ of an imaginary helix with a constant pitch, axially displaced within the range of $\pm 20$ millimeters in dependence upon the conicity of the bobbin, the crossing angle of the yarn on the bobbin, and the diameter and shape of the distributor.

Thus in FIG. 5, the solid line represents the function $\xi=\xi(\psi)$ relating to the bottom 5 of groove 12 of the grooved rotary yarn distributor 3 for winding yarn 8 onto a conical or varioconical bobbin 1, and the interrupted line 11 represents the function $\alpha=\alpha(\psi)$ of the imaginary helix with constant pitch. On the vertical axis, the axial coordinates $\xi$ of the actual helix 10 with variable rise of bottom 5 of groove 12, and the axial coordinates $\alpha$ of the imaginary helix 11 with constant pitch are plotted. On the horizontal axis, the angular coordinates $\psi$ within the seciton of double stroke is plotted.

Upon winding yarn 8 onto a conical or varioconical bobbin 1, the grooved rotary yarn distributor 3 rotates in the direction 9. By determining the coordinates $\xi$ for the separate positions of point of the bottom 5 of groove 12, i.e. by determining the course of the function, $\xi=\xi(\psi)$, according to the related function, $\rho=\rho(\psi)$, there is achieved the condition that from the distributing point C ( the imaginary distributing eyelet for yarn 8) the yarn is delivered in a direction which is in proximity to the tangent direction of the theoretical winding yarn 8 onto the conical or varioconical bobbin 1; this fulfills the condition of constant density and hardness within the whole range of the winding. At the same time, the winding between the walls 4 of the groove 12 is such that the yarn 8 leaves the bottom 5 of groove 12 towards the conical or varioconical bobbin 1 along a straight line, and does not bend about wall 4.

The application of the present invention is intended mainly for use in textile machines in which conical and varioconical bobbins are wound by means of grooved rotary yarn distributors. In the exemplary embodiment, the V-shaped groove is made by means of a conical milling machine, but also frusto-conical or cylindrical milling machines can be used. In that case, the bottom of the groove is formed by the edge of the groove bottom, by which the yarn is guided in the grooved rotary yarn distributor. This edge determines the separate positions of points C in the exemplary embodiment of the V-shaped groove.

Although the invention is described and illustrated with reference to a single embodiment thereof, it is to be expressly understood that it is in no way limited to the disclosure of such preferred embodiment but is capable of numerous modifications within the scope of the appended claims.

We claim:

1. In a grooved rotary yarn distributor of cylindrical shape with a reversing, helical yarn distributing groove and a variable radius of the bottom of the groove, the distributor is adapted for the winding of conical and varioconical bobbins with a variable crossing angle of the yarn to be wound for use on textile machines, the improvement wherein said bottom of its distributing groove, the first derivative of the axial coordinates of the bottom of the groove, according to the angular coordinate, is an increasing function of the angular coordinates in the proximity of a selected point in that case in which the first derivative of the radius of the bottom of the groove, according to the angular coordinate, is a decreasing function of the angular coordinate in the proximity of a selected point and is a decreasing function in that case, when the first derivative of the radius of the bottom of the groove, according to the angular coordinate, is an increasing function of the angular coordinate in the proximity of the selected point upon growth of the axial coordinate of the bottom of the groove only in the direction of distribution from the small end towards the large end of the conical or varioconical bobbin from zero up to the maximum value of the stroke of the grooved rotary yarn distributor.

2. Grooved rotary yarn distributor as claimed in claim 1, wherein the axial coordinate in the selected point of the helix with a variable rising of the bottom of the groove is axially displaced within the range $\pm 20$ millimeters, relative to the axial coordinate of the imaginary helix with constant pitch according to the conicity of the bobbin, the crossing angle of yarn on the conical or varioconical bobbin, and the diameter and shape of the grooved rotary yarn distributor.

* * * * *